United States Patent [19]

Hills

[11] Patent Number: 4,674,259

[45] Date of Patent: Jun. 23, 1987

[54] CONTAINER FILLING MACHINE

[75] Inventor: James B. Hills, Holden, Mass.

[73] Assignee: Package Machinery Company, East Longmeadow, Mass.

[21] Appl. No.: 898,247

[22] Filed: Aug. 20, 1986

[51] Int. Cl.[4] ..... B65B 5/10; B65B 39/00

[52] U.S. Cl. ..... 53/202; 53/237; 53/247; 53/500; 53/501

[58] Field of Search ..... 53/500, 501, 237, 246, 53/247, 244, 282, 202

[56] References Cited

U.S. PATENT DOCUMENTS

| | | | |
|---|---|---|---|
| 2,632,588 | 3/1953 | Hoar, Jr. | 53/501 |
| 3,081,588 | 3/1963 | Klapes et al. | 53/501 |
| 3,169,354 | 2/1965 | Bliss et al. | 53/247 X |
| 3,479,795 | 11/1969 | Martin | 53/202 X |
| 3,535,847 | 10/1970 | Strohmeier et al. | 53/501 |
| 3,705,475 | 12/1972 | Riley | 53/501 X |
| 3,964,233 | 6/1976 | Thomas | 53/247 X |
| 4,031,999 | 6/1977 | Wagner et al. | 53/500 X |
| 4,183,192 | 1/1980 | Smaw | 53/501 X |
| 4,194,343 | 3/1980 | Myers et al. | 53/244 X |
| 4,248,027 | 2/1981 | Cleary et al. | 53/244 |
| 4,265,072 | 5/1981 | Egli | 53/501 |
| 4,269,016 | 5/1981 | Kopp et al. | 53/202 X |

*Primary Examiner*—Horace M. Culver
*Attorney, Agent, or Firm*—McCormick, Paulding & Huber

[57] ABSTRACT

A container filling machine having a parallel series of elongated slats for movement in a closed path in a direction generally transverse to their length. The slats have cavities carrying articles such as capsules, tablets, caplets, etc. and deliver the same to a first set of horizontally extending chutes which in turn deliver the same to a second set of chutes there beneath. The first set of chutes is fixed with the second set of chutes being adapted for a "shuttle" or reciprocating movement so as to alternately deliver the articles to first and second rows of containers therebeneath. An associated conveyor has single and double container sections with a gate which alternately directs the containers to the first and second rows of containers in the double row section. Similarly, a pair of lead screws at the container filling station alternately assist in delivery, hold the containers in position for filling and thereafter discharge the filled containers. Alternatively, a pair of gates at each filling station may be employed to alternately hold the rows of containers thereat.

10 Claims, 4 Drawing Figures

CONTAINER FILLING MACHINE

BACKGROUND OF THE INVENTION

This invention relates to an improved machine for filling containers with small discrete articles such as capsules, tablets, caplets, etc. Prior art machines of a similar type are disclosed in the following U.S. Pat. Nos.:

U.S. Pat. No. 3,354,607 Slat Type Counting and Filling Machine

U.S. Pat. No. 3,925,960 Article Counting and Filling Machine

U.S. Pat. No. 4,017,003 Article Dispensing Machine

Container filling machines of the type under consideration and disclosed in the foregoing patents include a series of elongated horizontally extending slats in parallel relationship with supporting means for movement of the slats in a closed path and in a direction generally transverse to the length of the slats. The outer surfaces of at least some of the slats are provided with a multiplicity of longitudinally and horizontally spaced apart cavities for receiving small articles such as capsules, tablets, caplets, etc. and the path which the slats follow in their movement includes cavity charging and discharging stations. The small articles are introduced to the cavities of upright slats at the charging station and at the discharging station each slat tilts about its longitudinal centerline so that its cavities are moved from an upright or upwardly exposed to a downwardly exposed attitude, thus simultaneously discharging the articles from the cavities. Container delivery means are provided for the transport of containers to a filling station spaced generally beneath the discharge station of the article carrying slats. At least one horizontally extending series of article guiding chutes is provided between the discharge station of the slats and the filling station for the containers. The chutes are arranged in side-by-side relationship at the discharge station so as to guide the small articles downwardly through vertical paths in a gravity discharge from the slats. Each chute receives articles simultaneously discharged from a pre-determined number of cavities of each slat and successively from a pre-determined number of slats at the discharge station. The container count is thus determined by the number of cavities discharging from each slat to each chute and by the number of slats with their predetermined number of cavities arranged to discharge to the chute. When the proper count, or number of capsules, tablets or caplets, etc., has been introduced to each container, the containers are transported from the filling station, a succeeding row of containers is introduced to the filling station and the process is repeated.

The results achieved with machines of the general type described are generally satisfactory but there is always a need for enchanced speed of machine operation and the resulting improvement in production rates. Various designs have been proposed but have not been completely satisfactory in this regard.

It is the general object of the present invention to provide a container filling machine of the general type mentioned wherein a relatively simple, yet durable and dependable design is provided to enhance the speed of operation of the machine at economic advantage.

SUMMARY OF THE INVENTION

In fulfillment of the foregoing object and in accordance with the present invention, an improved container filling machine is provided with a parallel series of horizontally elongated slats. A support means for the slats provides for closed path movement of the slats in a direction generally transverse to their length. At least some of the slats have exposed outer surfaces with a multiplicity of horizontally spaced article receiving cavities therealong. The closed path of slat movement includes cavity charging and discharging stations and means such as a hopper may be provided at the charging station for depositing articles in the cavities. At the discharging station, at least the outer cavity bearing surface portion of each slat is tilted by the aforesaid supporting means for the simultaneous gravity discharge of the articles in the cavities of the slat. A first horizontally extending series of substantially vertical article guiding chutes is fixed in side-by-side relationship at the discharge station and beneath the slat tilting zone so that each chute receives articles discharged from a predetermined number of cavities in each slat when the latter is tilted. Each chute has an upwardly exposed inlet opening and a downwardly exposed outlet opening for the receipt and the gravity fall of articles therethrough.

In accordance with the present invention, there is provided a second horizontally extending series of substantially vertical article guiding chutes and said series of chutes is disposed beneath the first series of chutes so as to receive articles therefrom. Each chute in the second series of chutes has an upwardly exposed inlet opening and a downwardly exposed outlet opening substantially smaller than its inlet opening. A means supporting the second series of chutes is adapted for the simultaneous and substantially horizontal movement thereof generally transverse to the horizontal line of the series of chutes and between first and second parallel and linear positions. The inlet openings of the chutes of said second series are maintained in communication with the outlet openings of the chutes of the first series in both the first and second positions of the second series of chutes. Thus, the articles are free to fall through the second series of chutes in either of said positions.

Container delivery means for transporting first and second rows of containers are also provided and the rows of containers are moved along parallel paths which include first and second filling stations disposed respectively beneath the first and second linear positions of the second series of chutes. Thus, the articles introduced to the second series of chutes can be discharged therefrom alternately to containers in said first and second rows of containers depending upon the position of the chutes. A conventional operating means for the machine moves the slats through a closed path as mentioned, reciprocates the second series of chutes between their said first and second positions as mentioned and operates the container delivery means to alternately feed rows of containers to said first and second filling stations. Thus, the slats, chutes and delivery means are operated in timed relationship for the alternate filling of said first and second rows of containers respectively at the first and second filling stations.

Preferably, an article gate is provided between the outlet openings of the first series of chutes and the inlet openings of the chutes of the second series of chutes. The gate is supported for movement by said machine operating means between first and second positions respectively establishing and obstructing communication between the first and second series of chutes and thus operating to prevent the gravity fall of articles from the first series of chutes to the second series of chutes during movement of the latter.

The machine of the invention is also preferably adapted to handle a single row of containers, divide the said row of containers into parallel first and second rows of containers for alternate filling at first and second filling stations, and then discharge filled containers in a single row. Accordingly, the container delivery means of the machine includes a dividing means for separating a single incoming row of containers into first and second parallel rows of containers and this may include a gate provided at a junction of the conveyor between single and double row sections thereof. The gate is moved by operating means to alternately open one side and close the opposite side of the double row section of the conveyor in timed relationship with the filling of the containers at the first and second filling stations.

Still further, a pair of elongated lead screws are preferrably provided at the filling stations outboard of a central divider bar between the first and second rows of containers. The lead screws respectively engage the containers of the first and second parallel rows of containers and are operated alternately in timed relationship with the movement of the second series of article handling chutes. Thus, the lead screws alternately feed and fixedly position the rows of containers for the alternate feeding and filling and discharging thereof. A continuous conveyor beneath the containers also provides for the feeding and discharging of the rows of containers from the filling stations.

In an alternative embodiment of the present invention transverse container gates are provided in place of the aforementioned lead screws. At least one gate is provided in association with each row of containers and, preferably, a pair of gates is provided in operative association with each such row of containers. Thus, upstream and downstream gates are provided for each row of containers with the downstream gate being operative and the upstream gate inoperative during a filling operation of a row of containers. During a discharge operation of a row of containers, the upstream gate is operative with the doWnstream gate in an inoperative or retracted position. The operation of the gates associated with the first row of containers is in a reverse or alternating sense with respect to the gates associated with the second row of containers and the rows of containers are thus alternately introduced to the first and second filling stations, filled at the stations and discharged therefrom.

DISCLAIMER

Geometrical terminology such as horizontal and vertical etc. are employed throughout for convenience only and are in no way to be taken as limiting in either the specification or the claims which follow:

DESCRIPTION OF THE PREFERRED EMBODIMENTS

Figure 1:
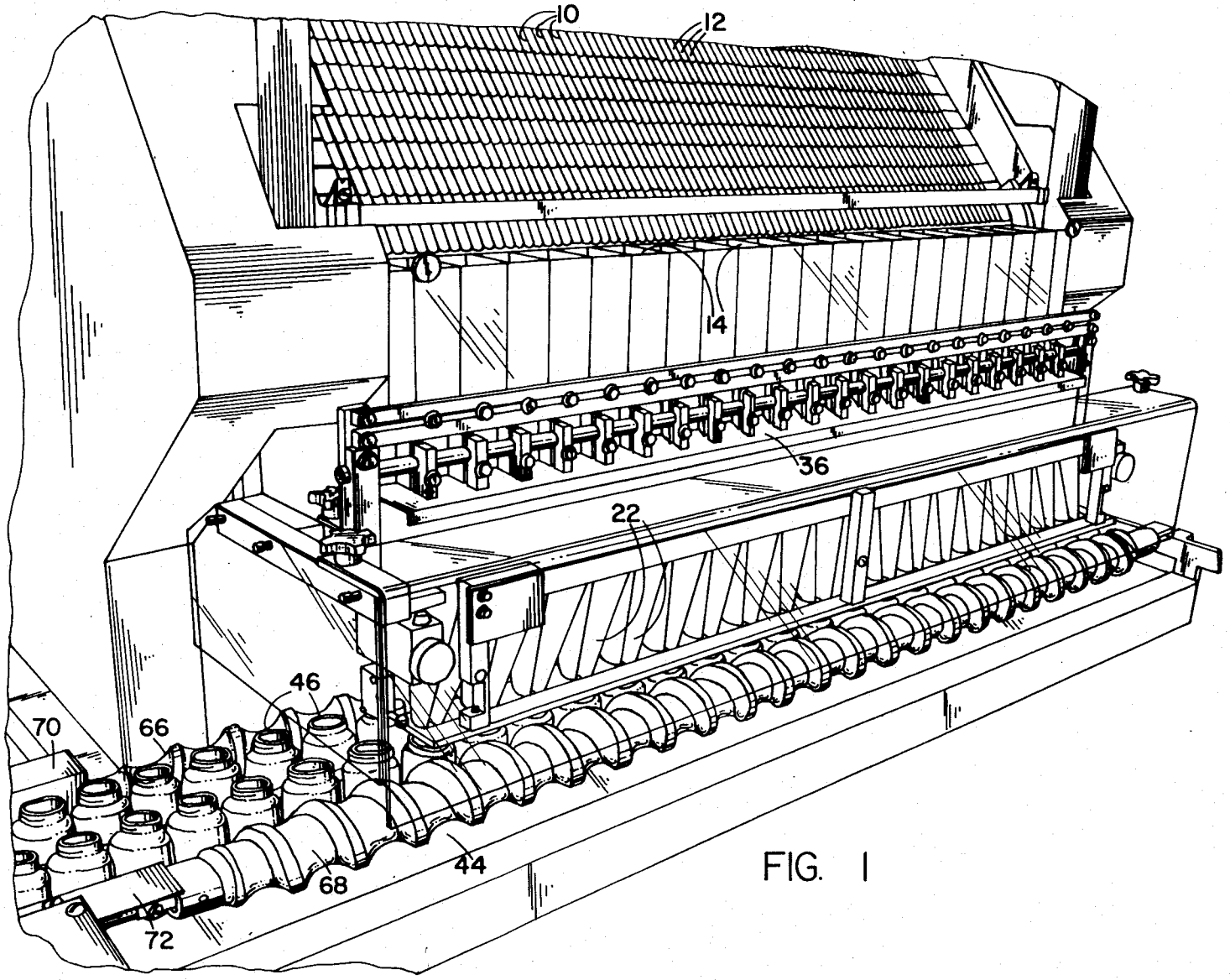
FIG. 1 of the drawings is a perspective view of the improved container filling machine of the present invention.

Referring particularly to FIG. 1, a container filling machine in accordance with the present invention includes a plurality of horizontally elongated slats 10, 10 and a means supporting the same for closed path movement in a direction generally transverse to their length. As shown, the slats 10, 10 move downwardly and forwardly in the machine and are then reversed in the direction of their movement as indicated generally in FIG. 2. That is, the slats pass arcuately in a reverse direction, angularly upwardly, arcuately in a forward and upward direction at the top of their path of movement and thence angularly downwardly as shown in FIG. 1. The slats also include a multiplicity of small cavities 12, 12 spaced along their length and such cavities are adapted for receiving small articles such as capsules, tablets, caplets etc. The slats 10, 10 move through charging and discharging stations in their closed path of movement and a charging station may be provided at an upper portion of the machine in the form a hopper and appropriate vibratory apparatus with a discharging station provided at a lower portion of the closed path of movement of the slats as illustrated at A in FIG. 2. At the discharging station A the slats such as 10, 10, and particularly the outer cavity bearing surface portions thereof, are tilted by their supporting means and, more particularly, moved arcuately as described so as to simultaneously discharge articles in the cavities 12, 12.

Figure 2:
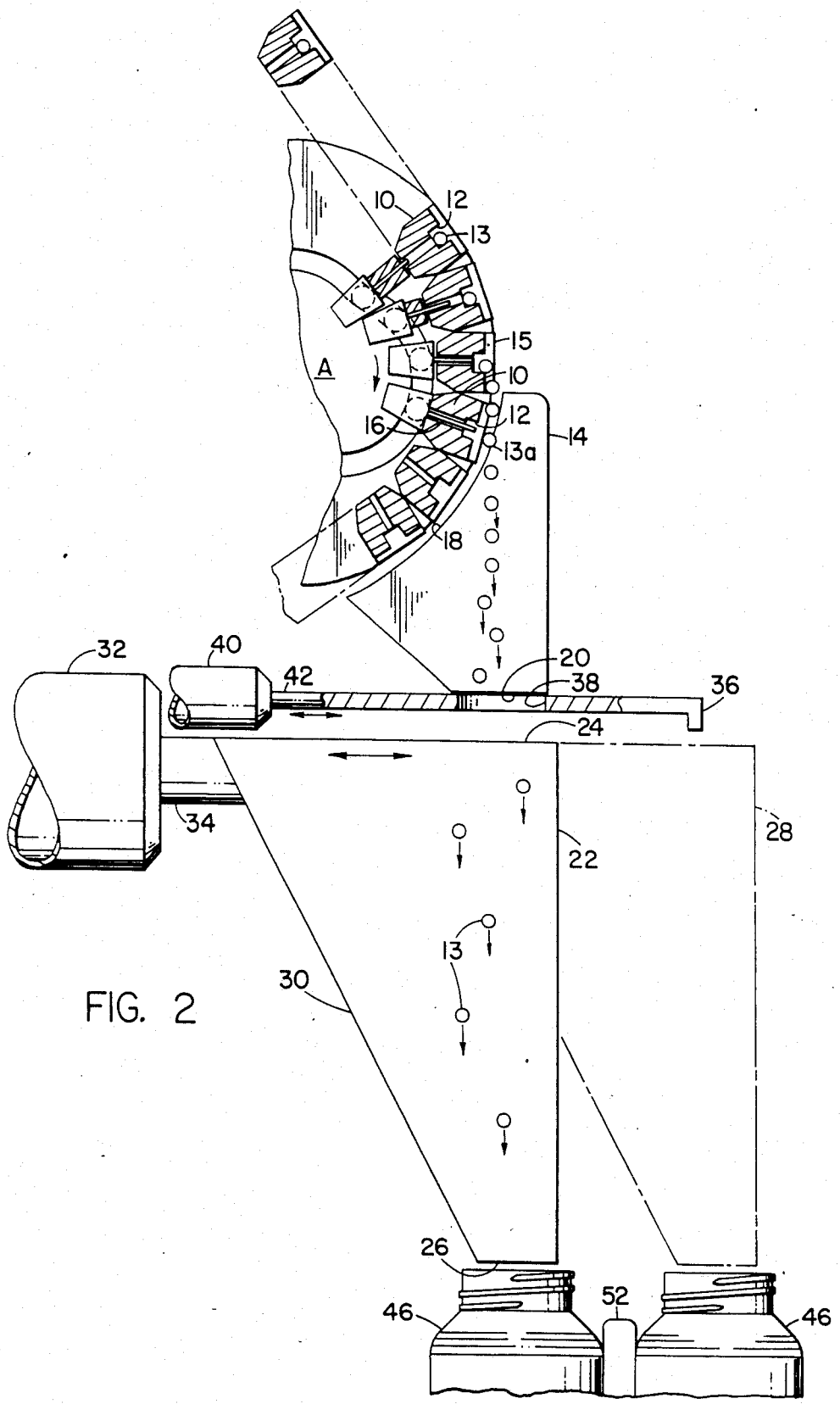
FIG. 2 is a schematic view showing a portion of an article carrying slat mechanism and first and second series of article handling chutes.

In FIG. 2, an uppermost slat 10, with a cavity 12 and an article 13 therein will tend to discharge the article therefrom at a position approximately at the broken line position of FIG. 15. In the event that the article does not fall freely from the cavity at the urging of gravity, a small ejector pin 16 will thereafter operate to eject an article such as the article 13*a*. The aforementioned U.S. Pat. No. 4,017,003 more fully describes the construction and operation of such an ejector mechanism. Reverting to FIG. 1, it will be seen that a plurality of slat cavities discharge into each of the chutes 14, 14 of a first horizontally extending series of vertical article guiding chutes. As shown in FIG. 2 each of the chutes 14 is provided with an arcuate upwardly and leftwardly exposed inlet opening 18 and a downwardly exposed outlet opening 20. Articles such as 13, 13*a* falling vertically through the chute 14 are directed to the outlet opening 20 by an inclined rear wall for discharge therethrough.

A second horizontally extending series of substantially vertical article guiding chutes 22, 22 is disposed beneath the first series of chutes so as to receive articles therefrom as best illustrated in FIG. 2. The chutes of the second series each have an upwardly exposed inlet opening 24 and a downwardly exposed outlet opening 26, the latter being substantially smaller than the former. As will be apparent in FIG. 2, the horizontal dimension of the inlet opening 24 is sufficiently large to provide for communication between the outlet opening 20 of the chute 14 with the inlet opening 24 irrespective of the position of the chute 22 in its full line or broken line position 28. The chute 22 has an inclined rear wall 30 which provides for the guiding of the articles therein such as the articles 13, 13 forwardly to the outlet opening 26 particularly when the chute is in its forward position at 28. The chutes 22, 22 are moved in unison from first to second or rearward to forward postions as illustrated in FIG. 2 by suitable operating means which may take the form of a fluid operable cylinder 32 having a rod 34 connected with suitable bracket means supporting the several chutes.

Preferably and as indicated at 36, an article gate is provided between the first and second series of chutes 14, 14 and 22, 22 and is moveable between open and closed positions. In its open position the gate 36 establishes communication between the chutes 14, 14 and 22, 22 via a gate opening 38. In a rearward position in FIG. 2 the gate 36 obstructs or prevents communication between said chutes 14, 14 and 22, 22 and prevents the gravity fall of articles from the upper to the lower chutes. Operating means for the present invention provide for operation of gate 36 in timed relationship with movement of the chutes 22, 22 forwardly and rearwardly so as to prevent the gravity fall of articles from the upper chutes to the lower chutes during movement of the lower chutes. Various operating means may of course be provided as in a simple form of fluid cylinder 40 with a rod 42 for moving the gate 36 between its opened and closed positions.

Figure 3:
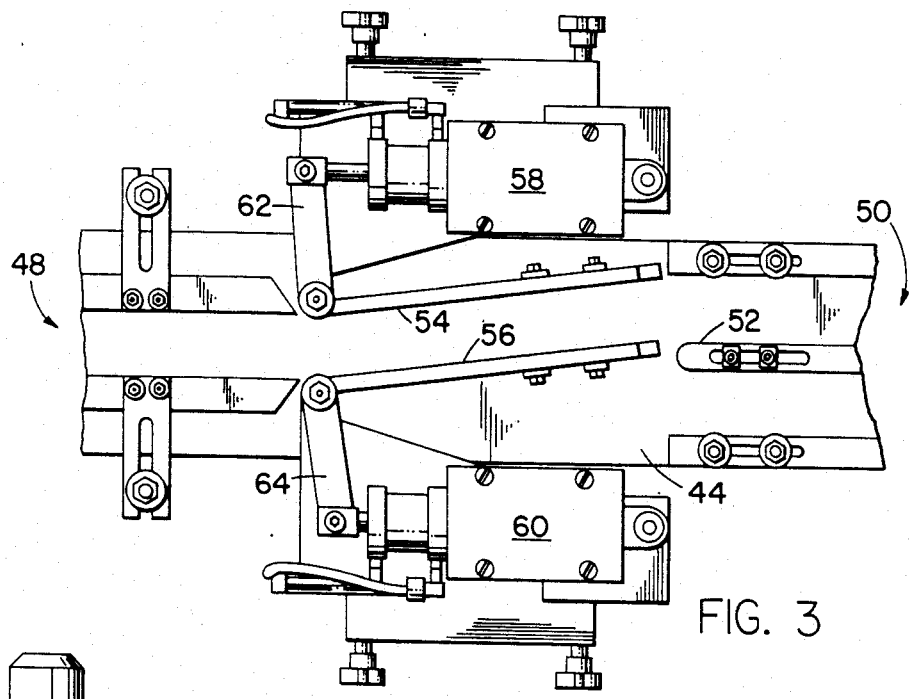
FIG. 3 is a top view of a container gate mechanism associated with a container delivery means of the present invention.

Container delivery means in accordance with the invention preferrably include a conveyor best illustrated at 44 in FIGS. 1 and 3 and which extends beneath and supports and transports a series of containers which may take the form of plastic bottles 46, 46 in FIGS. 1 and 2. As is best illustrated in FIGS. 1 and 2, first and second rows of plastic bottles or containers are provided respectively at first and second filling stations beneath the first and second positions of the second series of chutes 22, 22. Thus, the chutes 22, 22 can be moved between their first and second positions alternately to fill the containers in said first and second rows of containers as in FIG. 2.

As best illustrated in FIG. 3, the continuously movable conveyor 44 has first and second sections respectively adapted to accommodate single and double rows of containers 46. Such sections are shown at 48 and 50 respectively with a divider bar 52 provided in the double row section 50 to maintain the rows of containers in discrete first and second rows as aforesaid. Further, in FIG. 3 a container gate having spaced apart parallel arms 54, 56 is provided with associated fluid cylinder operating means 58, 60. The arms 54, 56 are connected by suitable linkage means at 62, 64 so as to be operated by their fluid cylinders 58, 60 in unison and in a pivoting movement through a small angle thus directing containers from the single conveyor section 48 alternately to the first and second rows of the double container section 50, the rows of containers being disposed on opposite sides of but adjacent the divider bar 52 as best illustrated in FIG. 2. Operation of the cylinders 58 and 60 is of course in timed relationship with the movement of the second series of chutes 22, 22, and the article gate 36.

At the filling stations beneath the chutes 22, 22 first and second elongated horizontally disposed lead screws 66, 68 are also provided as best illustrated in FIG. 1. Respective drive means 70, 72 for the lead screws rotate the screws alternately and in timed relationship with the alternate delivery of containers 46, 46 to the first and second filling stations beneath the chutes 22, 22. Thus, as a row of containers is delivered to the first filling station the first lead screw will be rotated to assist in the delivery and in the precise positioning of the containers at the station. Subsequent to filling of the containers, the lead screw will again be rotated to transport the containers away from the filling station in a container discharging operation. While the containers are at the filling station with the lead screw 66 in a non-rotative and fixed position the containers are positively and precisely held in position as required for filling. During subsequent rotation of the lead screw, a precise and positive discharge operation of the containers is provided for. The lead screw 68 of course operates in a similar manner but provides for the alternate delivery, filling and discharge of containers at the forward or second filling station.

Figure 4:
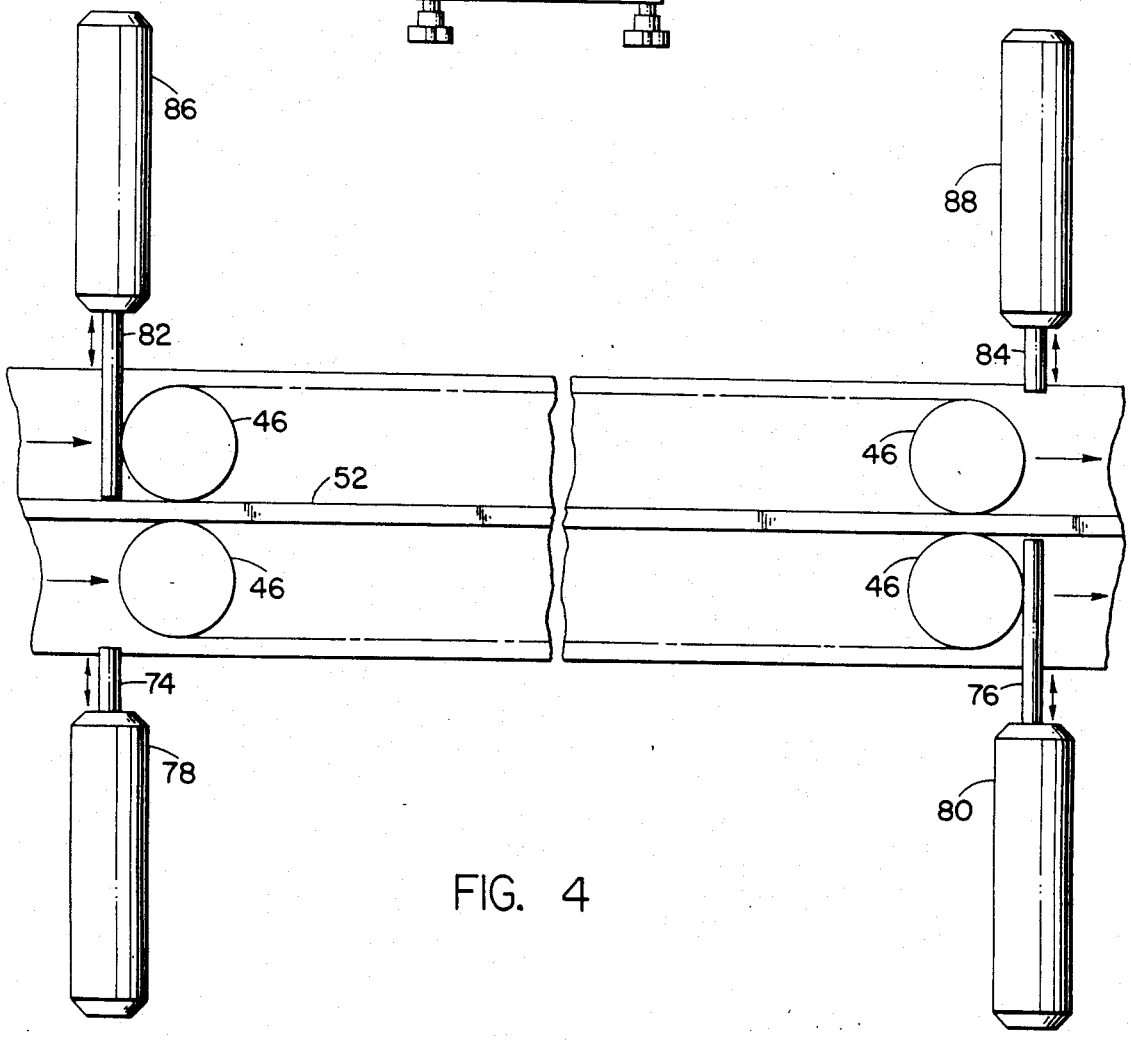
FIG. 4 is a schematic view of a container gate system at the filling stations of the machine.

In FIG. 4 an alternative arrangement at the filling station is illustrated wherein first and second or upstream and downstream gates 74, 76 are provided with respective operating cylinders 78, 80 at a front row of containers at the filling station and similar first and second gates 82, 84 are provided at the rear row of containers with respective cylinders 86, 88. As will be apparent, the gate 74 is maintained in the outer position as shown with the gate 76 maintained in the inner position during filling of the containers 46, 46 there between. On completion of a filling operation the gate 76 is withdrawn to an outer position to allow the containers to be discharged from the filling station with the gate 74 moved inwardly to prevent the passage of empty containers through the filling station. The gate 76 is then re-closed to capture and maintain a succeeding row of containers at the filling station with the gate 74 withdrawn to its initial position. The gates 82, and 84 operate similarly but provide for the alternate filling of rows of containers 46, 46 at the rear station as in the case of the lead screws 66, 68.

As will be apparent from the foregoing, the improved container filling machine of the present invention embodies a relatively simple design with the reciprocating or "shuttle chutes" 22, 22 and yet substantially enhances the speed of operation of the machine. The majority of the elements of the machine other than the chutes 22, 22, the gates 36, 54 and 56, etc. are conventional and time tested. Thus, a high degree of dependability and durability in service can be anticipated.

I claim:

1. A machine for filling each of a series of containers with a plurality of small discrete articles comprising a parallel series of horizontally elongated slats, means supporting said slats for closed path movement in a direction generally transverse to their length, at least some of said slats having exposed outer surfaces with a multiplicity of horizontally spaced article receiving cavities therealong, said closed path of slat movement including cavity charging and discharging stations, means at said charging station for depositing articles in said cavities, at least the outer cavity bearing surface portion of each slat being tilted by said supporting means at said discharge station for the simultaneous gravity discharge of the articles in the cavities of the slat, a first horizontally extending series of substantially vertical article guiding chutes fixed in side-by-side relationship at said discharge station and beneath the slat tilting zone such that each chute receives articles discharged from a predetermined number of cavities of each slat when the latter is tilted in an article discharging movement, each chute having an upwardly exposed inlet opening and a downwardly exposed outlet opening, a second horizontally extending series of substantially vertical article guiding chutes disposed beneath said first series of chutes to receive articles therefrom, each chute of said second series having an upwardly exposed inlet opening and a downwardly exposed outlet opening substantially smaller than its said inlet opening, means supporting said second series of chutes for simultaneous substantially horizontal movement generally transverse to the horizontal line of the series of chutes and between first and second parallel and linear positions, the inlet openings of said chutes being in communication with the outlet openings of said first series of chutes in both said first and second positions, container delivery means for transporting first and second rows of containers along parallel paths including first and second filling stations respectively beneath the first and second linear positions of said second series of chutes, and operating means for said slats, said second series of chutes and said container delivery means, said means moving said slats, chutes and delivery means in timed relationship for the alternate filling of said first and second rows of containers respectively at said first and second filling stations.

2. A machine for filling containers as set forth in claim 1 wherein said operating means causes said container delivery means to alternately transport and fixedly position first and second rows of containers at said first and second filling stations, and wherein said operating means moves said second series of chutes alternately between their said first and second positions in timed relationship with the feeding and positioning of said rows of containers.

3. A machine for filling containers as set forth in claim 1 wherein an article gate is provided between the outlet openings of the chutes of said first series of chutes and the inlet openings of the chutes of said second series of chutes, said gate being moveable by said operating means between first and second positions respectively establishing and obstructing communication between the chutes of said first and second series and thus operating to prevent the gravity fall of articles from said first series of chutes to said second series of chutes during movement of the latter.

4. A machine for filling containers as set forth in claim 1 wherein said container delivery means includes a dividing means for separating a single incoming row of containers into said first and second parallel rows of containers, said dividing means accommodating the alternate feeding and filling of said first and second rows of containers.

5. A machine for filling containers as set forth in claim 4 wherein said delivery means includes a conveyor supporting and movable beneath and with said containers thereon and having single and double container row sections, wherein a gate is provided at a junction between said single and double row sections of said conveyor and is moved by said operating means to alternately open one side and close the opposite side of the double row section of the conveyor.

6. A machine for filling containers as set forth in claim 4 wherein a central divider bar is provided between said parallel first and second rows of containers along said double row section of the conveyor, and wherein first and second elongated lead screws are provided respectively on outboard sides of said conveyor in spaced relationship with said central divider, said lead screws respectively engaging the containers of said first and second parallel rows of containers and said operating means alternately rotating the lead screws in timed relationship with the movement of the second series of article handling chutes and thus alternately feeding and fixedly positioning said rows of containers for the alternate feeding and filling thereof.

7. A machine for filling containers as set forth in claim 6 wherein said conveyor supporting said first and second rows of containers is maintained by said operating means in continuous movement, and wherein said lead screws nevertheless alternately serve to hold the containers in fixed position thereon and alternately assist in the positive discharge movement of the containers from their respective first and second filling stations.

8. A machine for filling containers as set forth in claim 1 wherein at least one transversely movable container gate is provided adjacent each of said first and second filling stations, said gates being operable alternately for the alternate feeding and filling of rows of containers as aforesaid.

9. A machine for filling containers as set forth in claim 8 wherein first and second alternately operable transverse gates are provided for each of said first and second row of containers adjacent said filling stations, each of said first gates being disposed in an upstream position and each of said second gates being disposed in a relative downstream position with the first gates moving outwardly to an inoperative position and the second gates moving inwardly to an operative position during filling of rows of containers at the respective filling stations, and said gates being reversely operated for the feeding and discharge movement of containers from the filling stations.

10. A machine for filling containers as set forth in claim 1 wherein fluid operable cylinders are provided as part of said operating means and serve to intermittently reciprocate said second series of chutes between their said first and second positions and to similarly intermittently reciprocate said article gate between said first and second series of chutes whereby to prevent the gravity fall through of articles during movement of the second series of chutes.

* * * * *